US006252560B1

(12) United States Patent
Tanaka et al.

(10) Patent No.: US 6,252,560 B1
(45) Date of Patent: Jun. 26, 2001

(54) MULTIBEAM ANTENNA HAVING AUXILIARY ANTENNA ELEMENTS

(75) Inventors: Makoto Tanaka, Kariya; Toshiya Saito, Chiryu, both of (JP)

(73) Assignee: Denso Corporation, Aichi-ken (JP)

( * ) Notice: Subject to any disclaimer, the term of this patent is extended or adjusted under 35 U.S.C. 154(b) by 0 days.

(21) Appl. No.: 09/510,113

(22) Filed: Feb. 22, 2000

(30) Foreign Application Priority Data

Feb. 22, 1999 (JP) ..... 11-043802

(51) Int. Cl.[7] ..... H01Q 21/00

(52) U.S. Cl. ..... 343/853; 343/713; 342/371; 342/375

(58) Field of Search ..... 343/713, 754, 343/778, 844, 850, 853, 852, 860; 342/371, 372, 373, 375, 378, 379; 455/428, 429

(56) References Cited

U.S. PATENT DOCUMENTS

| | | | | |
|---|---|---|---|---|
| 4,228,436 | * | 10/1980 | Dufort | 343/853 |
| 4,672,378 | * | 6/1987 | Drabowitch et al. | 342/379 |
| 4,837,580 | * | 6/1989 | Frazita | 342/374 |
| 5,233,358 | * | 8/1993 | Murphy | 342/375 |
| 5,493,306 | * | 2/1996 | Rudish et al. | 342/371 |
| 6,054,949 | * | 4/2000 | Grassmann | 342/383 |

OTHER PUBLICATIONS

Butler, J., Lowe, R., "*Beam–Forming Matrix Simplifies Design of Electronically Scanned Antennas*", *Electronic Design*, vol. 9, pp. 170–1763, Apr. 12, 1961.

Uehara et al., "*A 20GHz 12 Sector Antenna Using Planar Multibeam Arrays*", a general meeting of *1996 Electronic Information & Communication Society*, B–107, Mar. 28, 1996.

Fukada et al., "*A Study of Ceiling Installed Circularly Polarized Sector Antenna for Indoor High–Speed wireless Access*", a society meeting of a *1998 Electronic Information & Communication Society*, B–1–107, Oct. 2, 1998.

* cited by examiner

*Primary Examiner*—Tho Phan
(74) *Attorney, Agent, or Firm*—Fish & Richardson P.C.

(57) ABSTRACT

A multibeam antenna for forming multiple beams includes an antenna array and a Butler-matrix feeder circuit. The antenna array is composed of $2^n$ main antenna elements and a group of $2^n$ or less auxiliary antenna elements placed at either one or both sides of the main antenna elements. Antenna power is supplied to the antenna array from the Butler-matrix feeder circuit and is distributed to all the antenna elements with higher power to the elements located in the middle of the array and lower power to the elements located at sides of the array. Phase of the power supplied to the main antenna elements is shifted by 180-degree, and the phase-shifted power is distributed to predetermined auxiliary antenna elements. Thus, sidelobes associated with antenna beams are reduced and the beam directivity is improved.

16 Claims, 14 Drawing Sheets

MULTIBEAM ANTENNA HAVING AUXILIARY ANTENNA ELEMENTS

CROSS-REFERENCE TO RELATED APPLICATION

This application is based upon and claims benefit of priority of Japanese Patent Application No. Hei-11-43802 filed on Feb. 22, 1999, the content of which is incorporated herein by reference.

BACKGROUND OF THE INVENTION

1. Field of the Invention

The present invention relates to a multibeam antenna used in a wireless communication system, more particularly to a multibeam antenna which includes auxiliary antenna elements disposed next to main antenna elements and to an antenna system in which such an antenna is used.

2. Description of Related Art

An antenna for forming multiple beams by supplying power thereto from a Butler-matrix feeder circuit is known hitherto. The Butler-matrix feeder is proposed and described in ELECTRONIC DESIGN, VOL. 9, pp. 170–173, issued April, 1961 under a title "Beam-forming matrix simplifies design of electronically scanned antennas." The Butler-matrix feeder has $2^n$ input/output ports and composed of hybrid circuits and phase shifters both connected via transmission lines. $2^n$ antenna elements are connected to output ports of the Butler-matrix feeder and constitute an antenna array which forms $2^n$ beams.

FIG. 19 shows a multibeam antenna using the Butler-matrix feeder (referred to as a Butler-matrix antenna). A Butler-matrix feeder circuit 2 has input ports 1*a*–1*d,* and antenna elements 3*a*–3*d* constituting an antenna array are connected to the Butler-matrix feeder circuit 2. The Butler-matrix feeder circuit 2 is used for forming multiple beams each having a different radiation pattern, the number of which is equal to the number of input ports. The feeder circuit 2 includes first stage hybrid circuits 21*a,* 21*b,* constant-phase shifters 22*a,* 22*b,* and second stage hybrid circuits 23*a,* 23*b.* Electric power supplied from the input ports 1*a*–1*d* to the feeder circuit 2 is converted into outputs having a predetermined phase difference and is fed to four antenna elements 3*a*–3*d* which in turn form four beams to be transmitted to directions different from one another. The input ports 1*a*–1*d* function as output ports when outside radio waves are received by the antenna elements 3*a*–3*d.*

An example of a multibeam antenna circuit layout is shown in FIG. 20. In this example, micro-strip lines are used as transmission lines, and linearly polarized patch antennas are used as the antenna elements 3*a*–3*d.* The transmission lines are formed on both the front and rear surfaces of a three-layer substrate 4, and a ground plate is embedded in the substrate 4. The transmission lines on the front surface are connected to those on the rear surface via through-holes 24 formed on the substrate 4. More particularly, the first stage hybrid circuits 21*a,* 21*b* are formed on the front surface and the second stage hybrid circuits 22*a,* 22*b* on the rear surface. Each antenna element 3*a*–3*d* is connected to the second stage hybrid circuits 22*a,* 22*b* via a respective transmission line, and each second stage hybrid circuit 22*a,* 22*b* is connected to each first stage hybrid circuit 21*a,* 21*b* with respective two transmission lines as shown in FIG. 20 (solid lines are formed on the front surface and the dotted lines on the rear surface). There are eight connecting lines altogether, and one through-hole 24 corresponds to each connecting line. In this arrangement, phase difference due to the through holes 24 can be neglected.

Simulation results as to the circuit shown in FIG. 20 are shown in the graph of FIG. 21, assuming that a distance between neighboring two antenna elements is one half of the wavelength. The radiation pattern of four beams, i.e., relative power intensity versus beam angle, is plotted together with sidelobes. In the Butler-matrix antenna, the power fed from the input ports is distributed to the output ports with the same amplitude and a predetermined phase difference. Accordingly, the beam shapes formed by the antenna are solely determined depending on the distance among antenna elements, and formation of large sidelobes is unavoidable, as generally known. Moreover, the number of the antenna elements is limited to the numbers which are in units of $2^n$, i.e., 2, 4, 8, 16, etc. Therefore, it is difficult to arbitrarily increase the antenna gain.

SUMMARY OF THE INVENTION

The present invention has been made in view of the above-mentioned problems, and an object of the present invention is to provide an improved multibeam antenna in which the sidelobes are reduced and an arbitrary gain increase is readily available. Another object of the present invention is to provide antenna systems using such an improved antenna in wireless communication.

The multibeam antenna according to the present invention is composed of a Butler-matrix feeder circuit and an antenna array that includes main antenna elements and auxiliary antenna elements. In the antenna array, $2^n$ main antenna elements are located in the middle, and a group of auxiliary antennas consisting of $2^n$ or less auxiliary antenna elements is located at either one or both sides of the main antenna elements.

Antenna power is supplied to the antenna array from the Butler-matrix feeder circuit. All the main and auxiliary antenna elements are arranged in line with equal intervals therebetween. A phase of power supplied to one of the main antenna elements is shifted by 180-degree, and the phase-shifted power is fed to one of the auxiliary antenna elements that is located $2^n$ antenna element apart from that main antenna element. A phase difference between two neighboring antenna elements is made all equal throughout the antenna array. The antenna power is distributed to all the antenna elements, so that higher power is fed to the elements located in the center portion of the array, and lower power to the elements located remote from the center portion. All the multiple beams formed by the antenna array are used in wireless communication, or one or more beams may be selectively used.

For example, four main antenna elements are placed in line in the middle portion of the array, and one each auxiliary antenna element is placed at both sides of the main antenna elements. All the elements arranged in line are sequentially numbered from the left to the right, i.e., No. 1 to No. 6. The phase of the power supplied to No. 5 main antenna element is shifted by 180-degree, and the phase-shifted power is supplied to No. 1 auxiliary antenna element. Similarly, the power supplied to No. 2 main antenna element is distributed to No. 6 auxiliary antenna element after the phase of the power is shifted by 180-degree. The power is distributed to each antenna element with ratios, for example, 0.1, 0.9, 1.0, 1.0, 0.9 and 0.1 from the left to the right.

According to the present invention, sidelobes of the multiple beams formed by the antenna array are reduced, and the beam directivity is improved. Moreover, the antenna gain can be improved by properly arranging the antenna elements and properly setting the power distribution among the antenna elements.

The multibeam antenna of the present invention can be used in various antenna systems in wireless communication. For example, three multibeam antennas may be placed around a triangular or cylindrical pillar so that the multiple beams are transmitted to all directions to cover 360-degree communication. The multibeam antenna may be used in mobile communication by using it as an on-board antenna mounted on an automobile, or using it as an antenna located over a road or a highway. In the mobile communication system, the multibeam antenna may be used both as an one-board antenna and as a communication terminal antenna.

Other objects and features of the present invention will become more readily apparent from a better understanding of the preferred embodiments described below with reference to the following drawings.

DETAILED DESCRIPTION OF THE PREFERRED EMBODIMENTS

Figure 1:
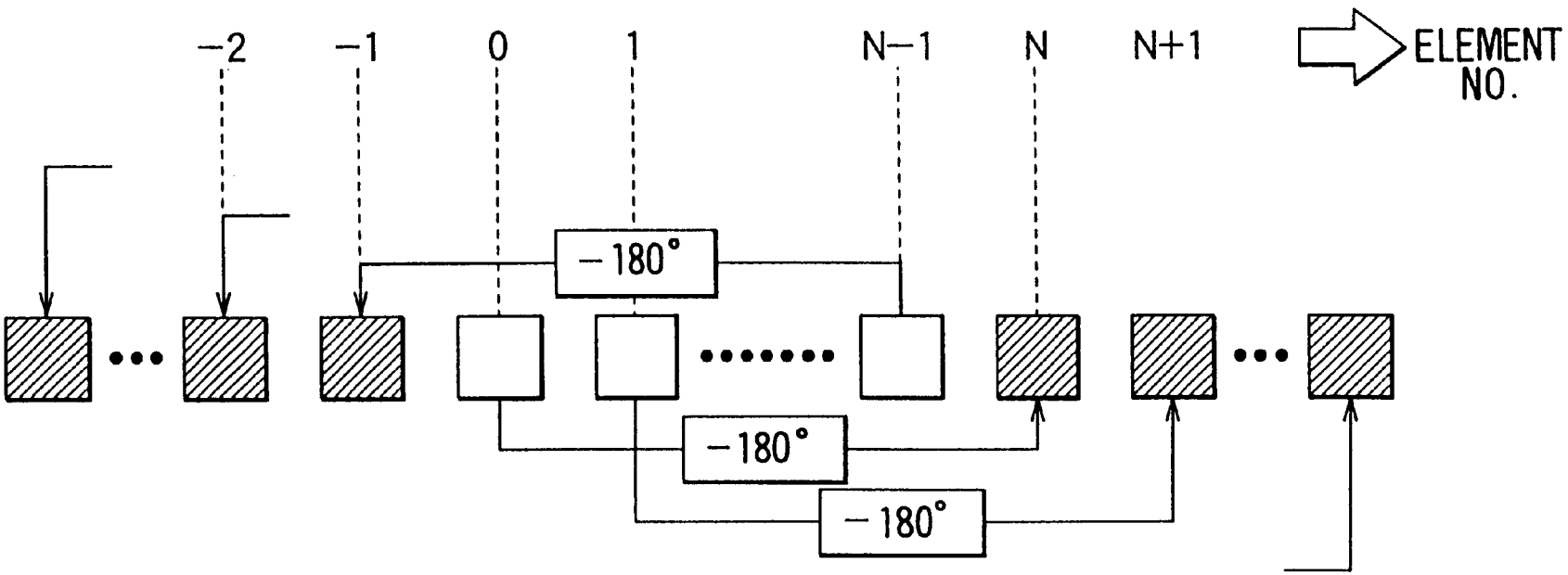
FIG. 1 is a block diagram showing a general concept of the present invention.
Figure 2:
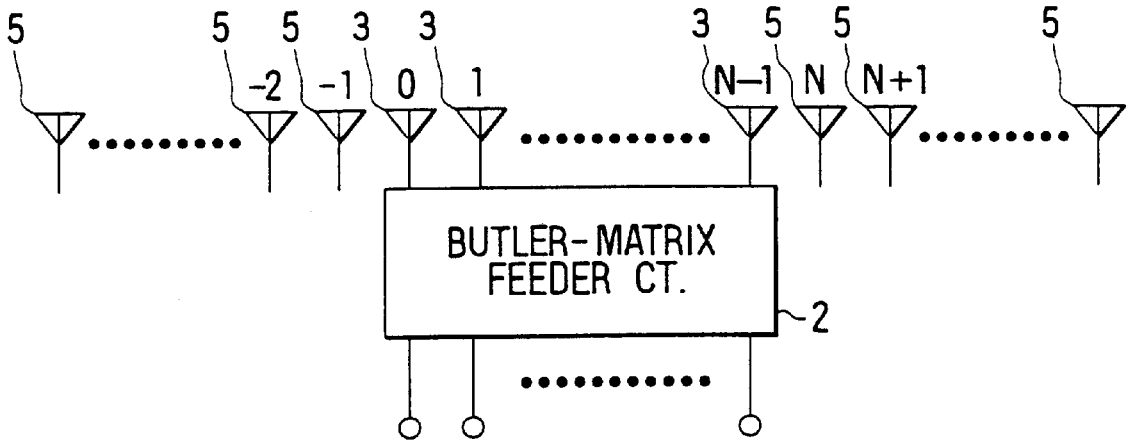
FIG. 2 is a schematic drawing showing main and auxiliary antennas connected to a Butler-matrix feeder circuit according to the present invention.

The concept of the present invention will be explained in reference to FIGS. 1 and 2. Auxiliary antenna elements are added to main antenna elements, and power is distributed also to the auxiliary antenna elements from a Butler-matrix feeder circuit. As shown in FIG. 1, the auxiliary antenna elements (N+1), (N+2) . . . are added to the right side of the main antenna elements (0), (1), (2) . . . (N−1), and the auxiliary antenna elements (−1), (−2) . . . are added to the left side of the main antenna elements. As shown in FIG. 2, antenna power fed to the main antenna elements 3 from the Butler-matrix feeder circuit 2 is distributed to the auxiliary antenna elements 5.

In this arrangement, the number of the main antenna elements is N ($N=2^n$) and the input port number is M (M=0, 1 . . . (N−1)). If phase difference Pd between two neighboring antenna elements is all equal, the phase difference is expressed as follows:

$$Pd=(2M-N+1)\times(\pi/N)$$

If the initial phase of the $0^{th}$ antenna element is α, the phase of the $(N-1)^{th}$ antenna element is expressed as follows:

$$P_{(N-1)}=(2M-N+1)\times(N-1)\times(\pi/N)+\alpha$$

When the phase $P_{(N-1)}$ is shifted by 180 degrees, the shifted phase is:

$$P_{(N-1)}-\pi=(2M-N+1)\times(N-1)\times(\pi/N)+\alpha-\pi=(2M-N)\times\pi-(2M-N+1)\times(\pi/N)+\alpha$$

Since N is $2^n$, the term (2M−N)×π in the above formula is expressed in units of 2π, which means that this term does not change the phase. Accordingly, this term can be neglected, and the above formula is changed to the following formula:

$$P_{(N-1)}-\pi=(2M-N+1)\times(-1)\times(\pi/N)+\alpha$$

This means that if the phase of the $(N-1)^{th}$ antenna element is shifted by 180 degrees, the shifted phase becomes the phase of the $(-1)^{th}$ antenna element. This relation can be applied to other antenna elements, that is, 180° shifted $(N-2)^{th}$ antenna element phase is equal to the $(-2)^{th}$ antenna element phase, 180° shifted $(0)^{th}$ antenna element phase is equal to the $(N)^{th}$ antenna element phase, and so on. Applying the above relation, the number of the auxiliary antenna elements to be added to the left side of the main antenna elements can be increased up to N, i.e., up to the $(-N)^{th}$ antenna element. Similarly, N auxiliary antenna elements can be added to the right side of the main antenna elements, i.e., up to the $(N+N)^{th}$ antenna element. Though the phase can be either advanced or delayed with the same effect, the delayed phase will be discussed as an example in the following description.

As shown in FIG. 1, the power 180° shifted from that of a main antenna element is fed to an auxiliary antenna element that is apart by N from the main antenna element. For example, the power 180° shifted from the power fed to the $(N-1)^{th}$ main antenna element is given to the $(-1)^{th}$ auxiliary antenna element, and similarly the $(0)^{th}$ main element corresponds to $(N)^{th}$ auxiliary element, the $(1)^{st}$ main element corresponds to the (N+1) auxiliary element, and so on. In this manner, the phase difference between two neighboring antenna elements can be made all equal.

FIG. 2 shows the antenna having N main antenna elements 3, from $(0)^{th}$ to $(N-1)^{th}$, the right side auxiliary antenna elements 5, from $(N)^{th}$ to $(N+N)^{th}$, and the left side antenna elements 5, from $(-1)^{th}$ to $(-N)^{th}$. The power from the Butler-matrix feeder circuit 2 is distributed to all the main antenna elements and the auxiliary antenna elements, shifting its phase in the manner as described above. The power distributed to each antenna element can be variously changed, and thereby the antenna gain can be improved and the sidelobes are reduced.

Figure 3:
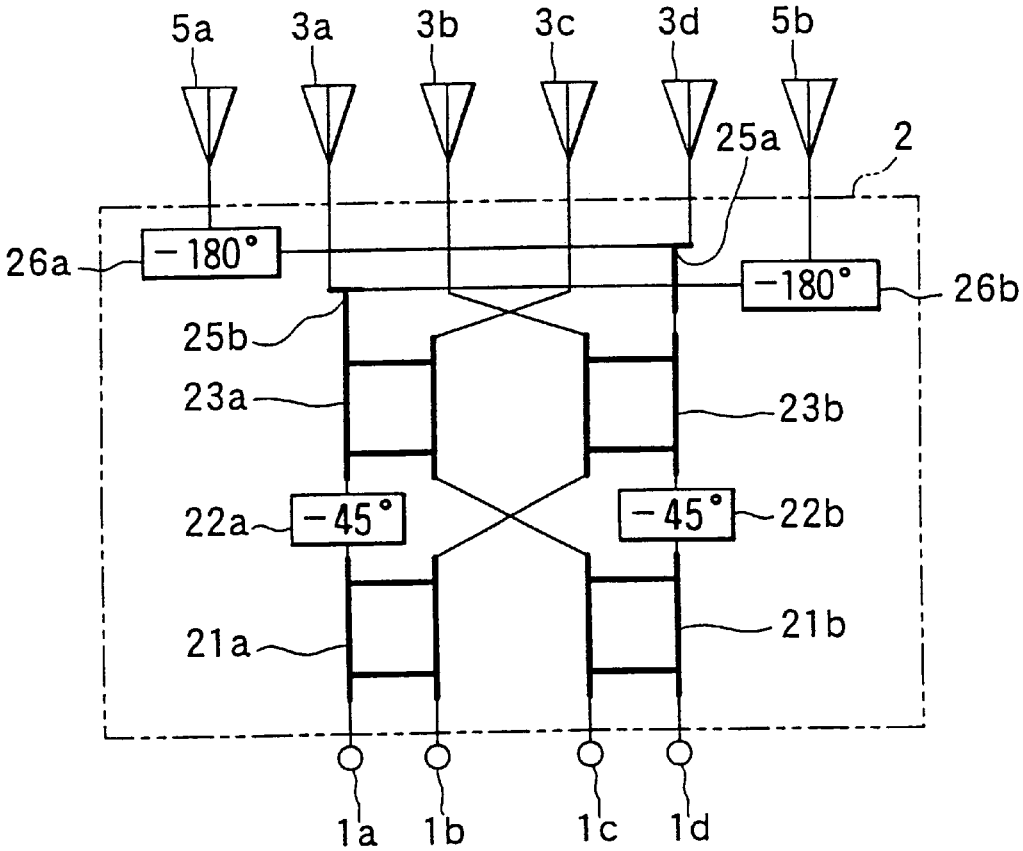
FIG. 3 is a drawing showing a structure of a multibeam antenna as a first embodiment of the present invention.

A multibeam antenna as the first embodiment of the present invention is shown in FIG. 3. The first embodiment is composed of a Butler-matrix feeder circuit 2, four input ports 1*a*–1*d* connected thereto, four main antenna elements 3*a*–3*d* and two auxiliary antenna elements 5*a*, 5*b*. One auxiliary antenna element 5*a* is located at the left side of the main antenna elements and the other element 5*b* is located at the right side.

The Butler-matrix feeder circuit 2 includes first stage hybrid circuits 21*a*, 21*b*, constant-phase shifters 22*a*, 22*b*, second stage hybrid circuits 23*a*, 23*b*, power dividers 25*a*, 25*b*, and delay lines 26*a*, 26*b*. These components and the antenna elements are connected as shown in FIG. 3 through transmission lines. The power fed to the main antenna element 3*d* is also fed to the auxiliary antenna element 5*a* by shifting its phase by 180° through the delay line 26*a*. Similarly, the power fed to the main antenna element 3*a* is also fed to the auxiliary antenna element 5*b* by shifting its phase by 180° through the delay line 26*b*. By distributing the antenna power to the auxiliary antenna elements 5*a*, 5*b* in this manner, all the phase differences between two neighboring antenna elements including the auxiliary antenna elements can be made equal.

Figure 4:
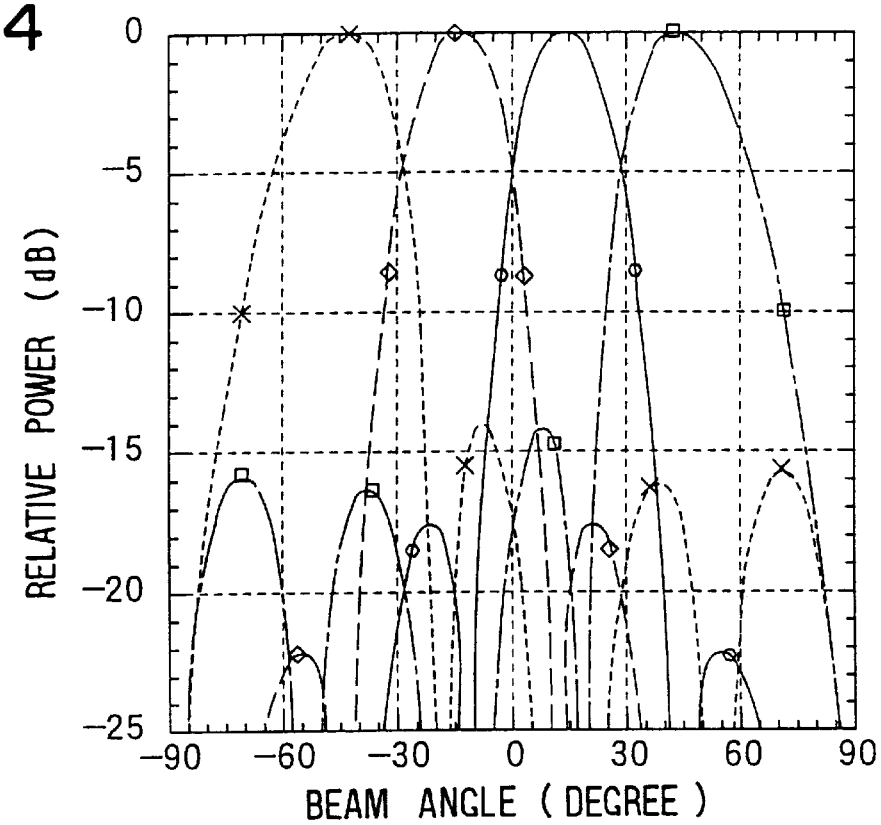
FIG. 4 is a graph showing a radiation pattern of the multibeam antenna of the first embodiment, which is obtained by simulation with an antenna element distance of 0.5 wavelength and power distribution ratios of 0.1, 0.9, 1.0, 1.0, 0.9 and 0.1.
Figure 21:
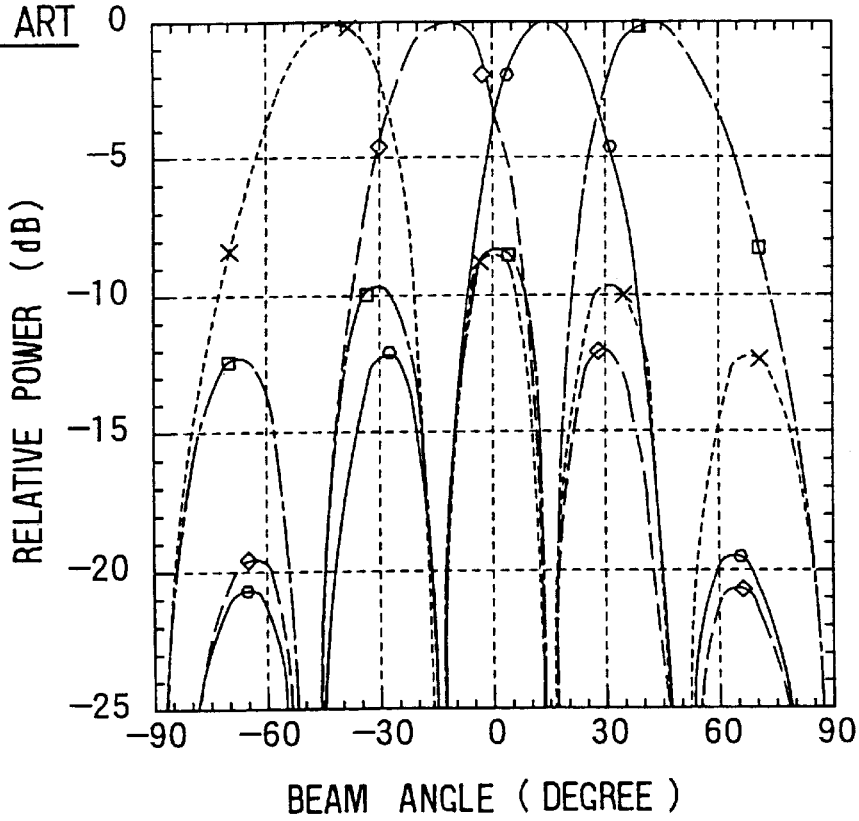
FIG. 21 PRIOR ART
FIG. 21 is a graph showing a radiation pattern of the conventional Butler-matrix antenna shown in FIG. 19, which is obtained by simulation with an antenna element distance of 0.5 wavelength.

The radiation pattern of the multibeam antenna shown in FIG. 3 is plotted in the graph of FIG. 4, in which relative power in dB is plotted on the ordinate versus the beam angle on the abscissa. This graph is obtained by simulation under the conditions that all the antenna elements including the auxiliary antenna elements are placed with an equal interval of 0.5 wavelength and that the antenna power is distributed to each antenna element with ratios 0.1, 0.9, 1.0, 1.0, 0.9, and 0.1 (from the left to the right in FIG. 3). The radiation pattern of the conventional multibeam antenna shown in FIG. 21 reveals that there are sidelobes of −8 dB level. In contrast, it is seen in FIG. 4 that the sidelobe level of the first embodiment is reduced to a level of −15 dB. This means that the sidelobe level can be reduced by placing auxiliary antenna elements at both sides of the main antenna elements and by distributing low power to auxiliary antenna elements.

Figure 5:
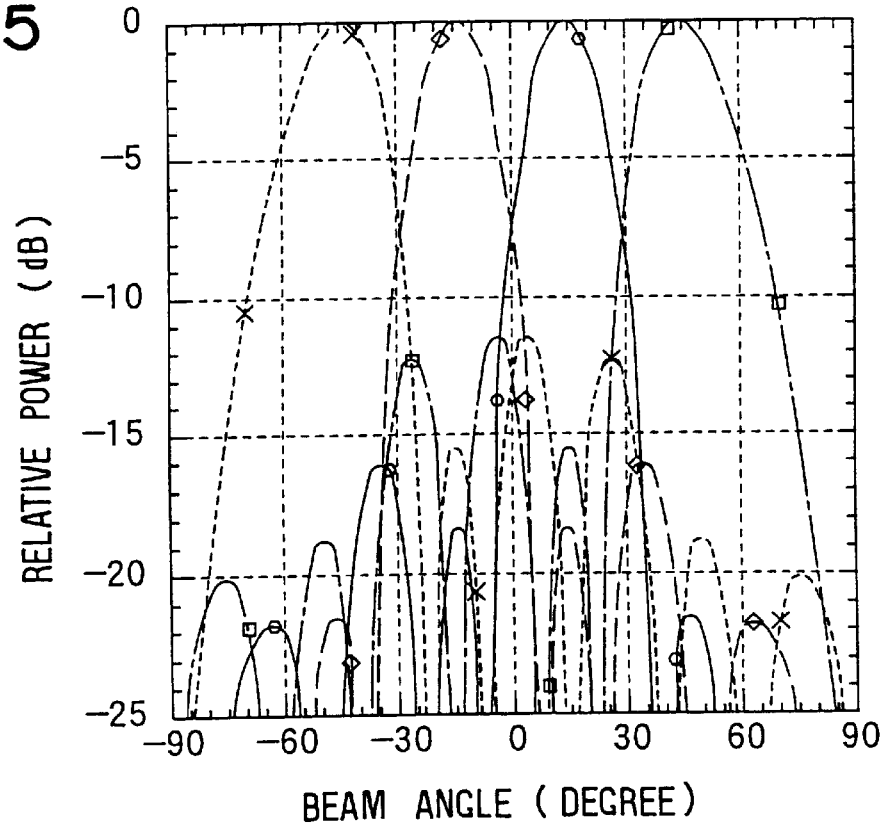
FIG. 5 is a graph showing a radiation pattern of the multibeam antenna of the first embodiment, which is obtained by simulation with an antenna element distance of 0.5 wavelength and power distribution ratios of 0.5, 0.5, 1.0, 1.0, 0.5 and 0.5.

FIG. 5 shows the radiation pattern of the multibeam antenna of the first embodiment obtained in the similar manner as in FIG. 4. However, in this simulation, the antenna power distribution ratios are modified to 0.5, 0.5, 1.0, 1.0, 0.5 and 0.5 (from the left to the right), though the antenna distance is the same, i.e., 0.5 wavelength. It is seen in this graph that the beam gain is increased (the width of the beams is narrowed).

Figure 20:
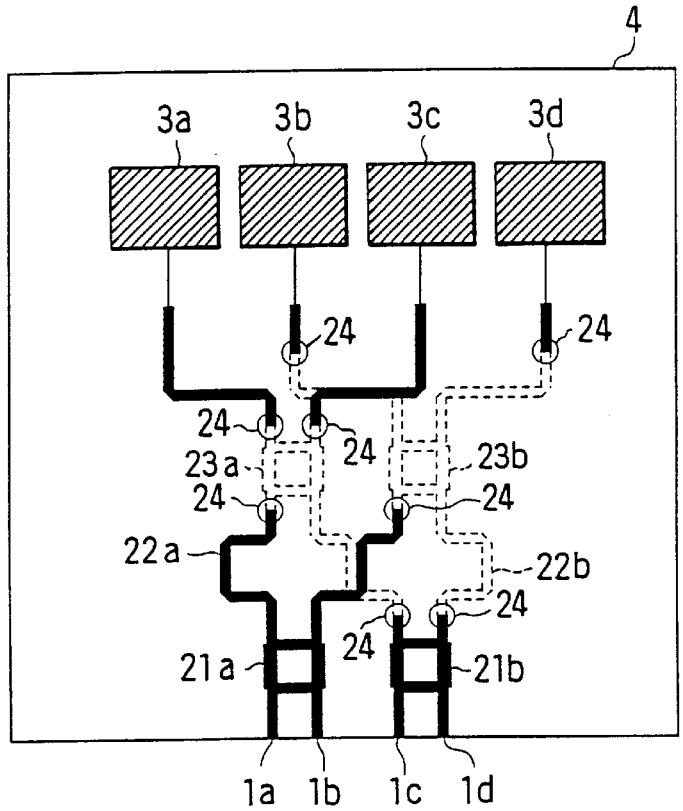
FIG. 20 PRIOR ART
FIG. 20 is a circuit diagram showing a layout of the conventional Butler-matrix antenna shown in FIG. 19.

In the Butler-matrix feeder circuit 2 shown in FIG. 3, the transmission line (or feeder line) for supplying power to the auxiliary antenna element 5*a* through the delay line 26*a* crosses three other transmission lines connected to the main antenna elements 3*a*, 3*b*, 3*c*. Similarly, the transmission line for supplying power to the auxiliary antenna element 5*b* trough the delay line 26*b* crosses three other transmission lines connected to the main antenna elements 3*b*, 3*c*, 3*d*. Therefore, it is impossible to make through-holes in the three-layer substrate, so that each through-hole corresponds to a respective transmission line as described in reference to FIG. 20. To cope with this problem, the Butler-matrix feeder circuit 2 is modified to the form shown in FIG. 6.

Figure 6:
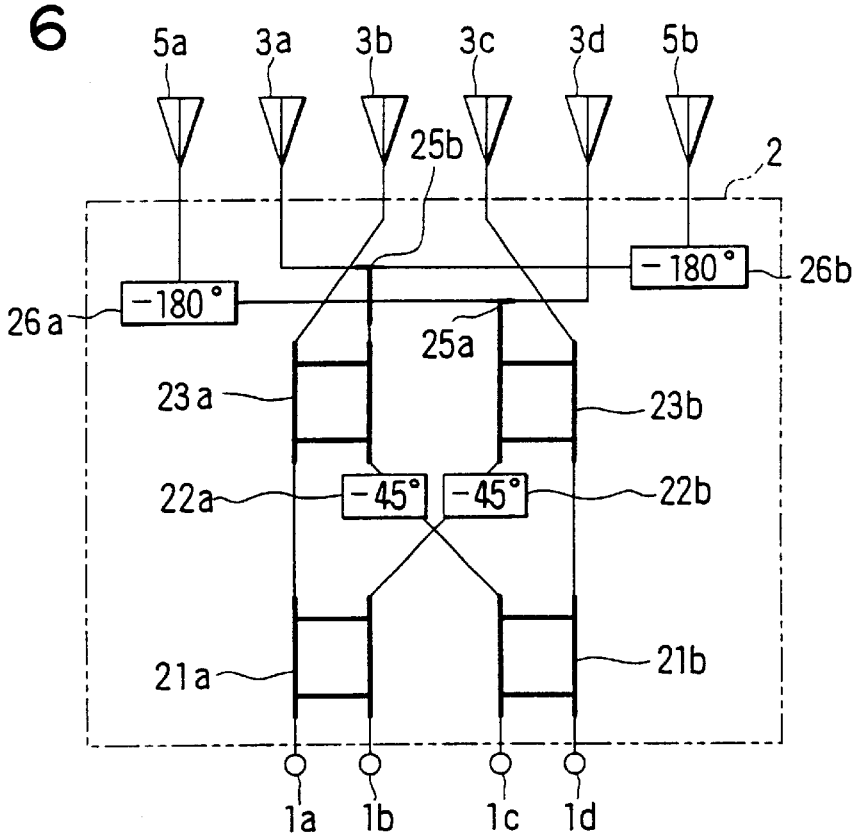
FIG. 6 is a drawing showing a modified form of the first embodiment shown in FIG. 3.

In the circuit shown in FIG. 6, the power dividers 25*a*, 25*b* are moved to the inside space, and the constant-phase shifters 22*a*, 22*b* are also moved to the positions shown. By modifying the circuit in this manner, the transmission line connected to the element 3*a* crosses the transmission line connected to the element 3*b* at the outside of the power divider 25*b*. Similarly, the transmission line connected to element 3*d* crosses the transmission line connected element 3*c* at the outside of the power divider 25*a*. Accordingly, the number of crossings of the transmission lines connected to the power dividers 25*a*, 25*b* with other transmission lines can be made two or less. In this manner, the through-holes 24 can be formed so that one through-hole corresponds to one transmission line. A layout for realizing the circuit of FIG. 6 is shown in FIG. 7.

Figure 7:
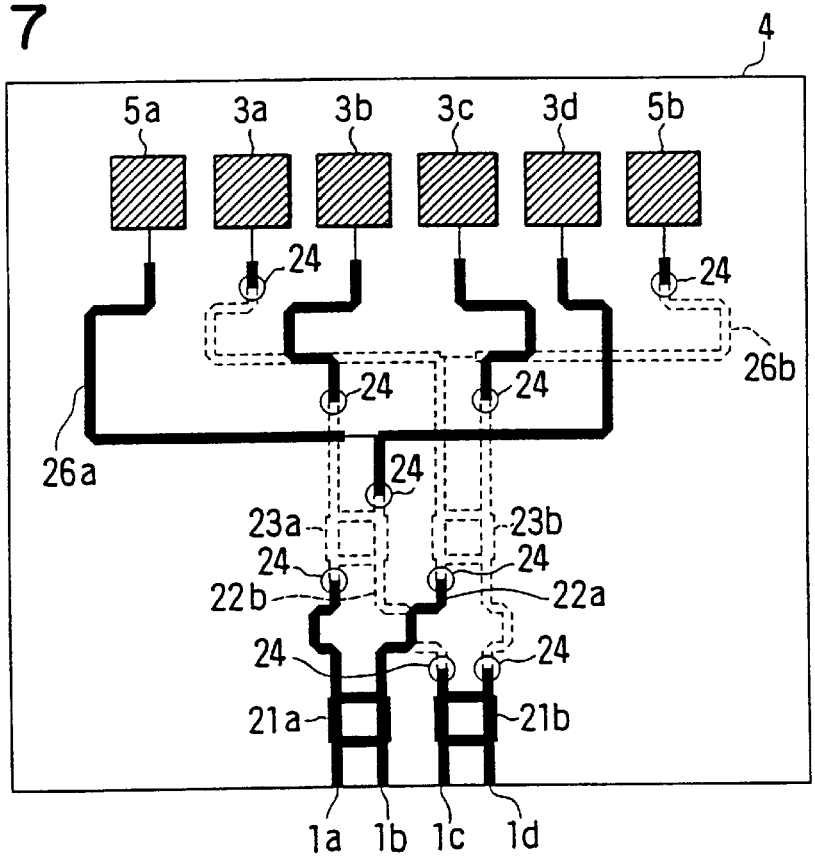
FIG. 7 is a circuit diagram showing a layout of the multibeam antenna shown in FIG. 6.

A substrate 4 shown in FIG. 7 is a three-layer substrate having a front surface on which elements and components shown with solid lines are formed, a rear surface on which components shown with dotted lines are formed, and intermediate layer that constitutes a ground plate. In this layout, micro-strip lines are used as the transmission lines, and linearly polarized patch antennas are used as the main and auxiliary antenna elements 3*a*–3*d*, 5*a* and 5*b*. The transmission lines formed on the front surface are connected to those formed on the rear surface via through-holes 24. Each through-hole 24 corresponds to one transmission line that connects an antenna element to a second stage hybrid circuit, or a second stage hybrid circuit to a first stage hybrid circuit. Therefore, the phase shifts caused by the through-holes 24 can be neglected and circuit loss can be minimized. In addition, since the first stage hybrid circuits 21*a*, 21*b* are formed on the front surface and the second stage hybrid circuits 23*a*, 23*b* are formed on the rear surface, ground terminals of connectors such as SMAs connected to the input ports laid are easily connected to the ground plate embedded in the substrate 4. The substrate 4 is made of a material having a low permittivity and a low dielectric loss such as Teflon.

Figure 8:
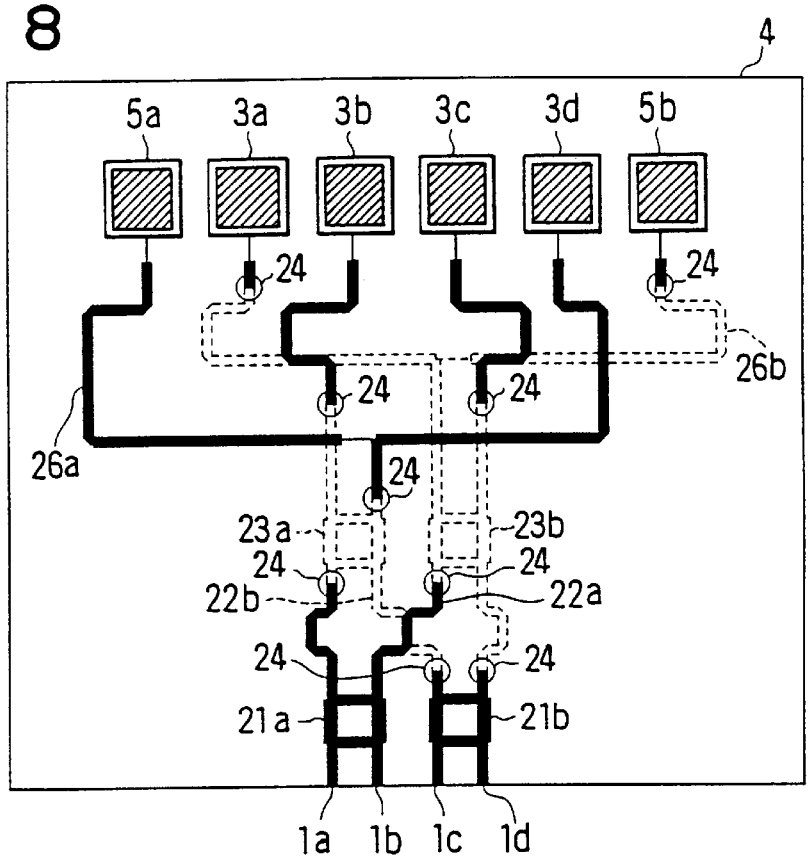
FIG. 8 is a circuit diagram showing a layout modified from that shown in FIG. 7.

In the layout shown in FIG. 8, the antenna elements 3*a*–3*d*, 5*a* and 5*b*, which are linearly polarized antennas in FIG. 7, are all replaced with circularly polarized antenna elements. This arrangement has an advantage to suppress the multi-path of odd-times-reflections, as described in article B-1-107 entitled "A study of ceiling installed circularly polarized sector antenna for indoor high-speed wireless access" reported at a 1998 meeting of Electronic Information & Communication Society.

Figure 9:
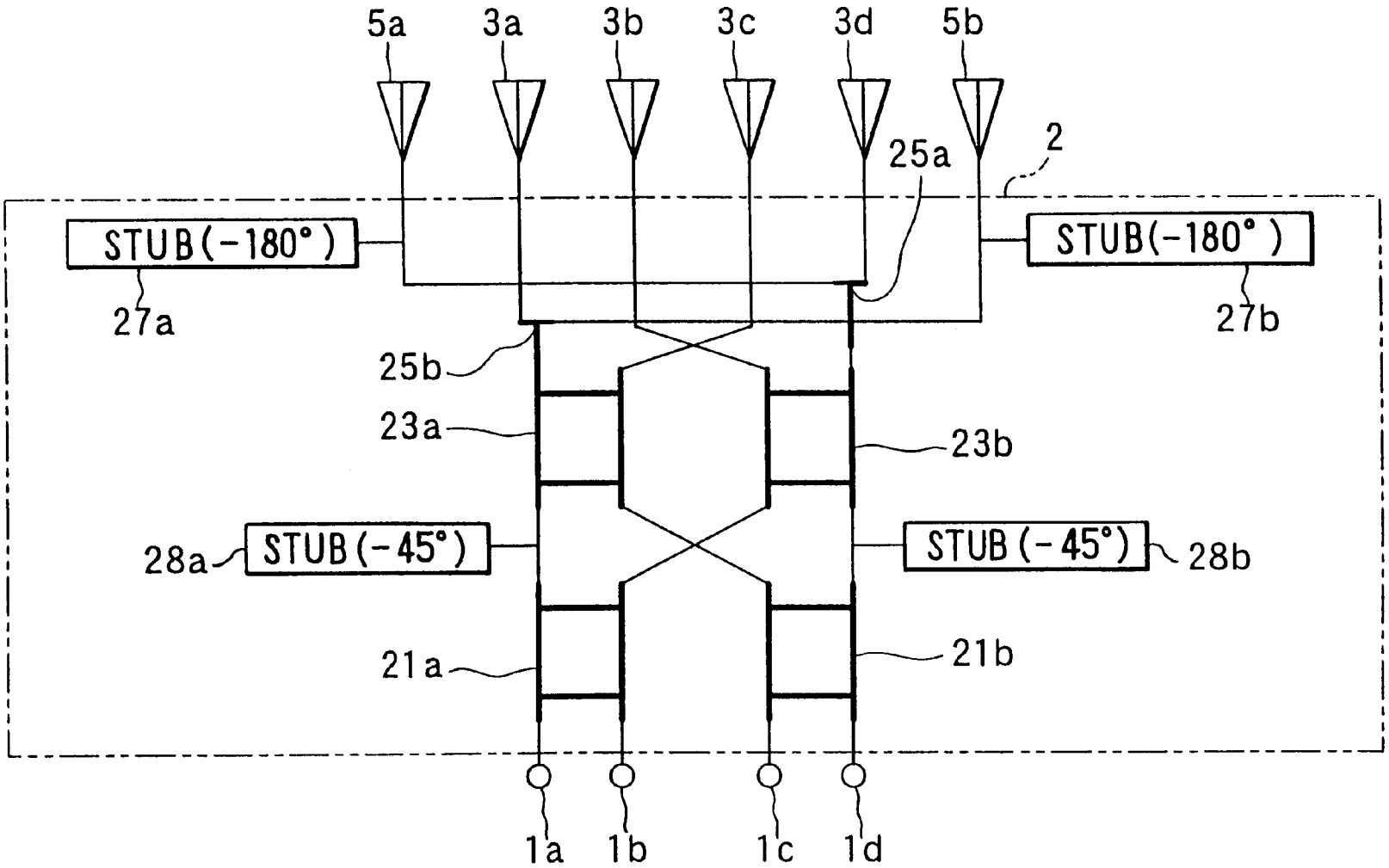
FIG. 9 is a drawing showing a modified form of the first embodiment shown in FIG. 3.

A modified form of the Butler-matrix feeder circuit 2 is shown in FIG. 9, in which the delay lines 26*a*, 26*b* shown in FIG. 3 are replaced with stubs 27*a*, 27*b*, and the constant-phase shifters 22*a,* 22*b* shown in FIG. 3 are also replaced with stubs 28*a,* 28*b.* When the delay lines 26*a,* 26*b* are used, unnecessary corners are formed by them as shown in FIG. 7. By replacing the delay lines 26*a,* 26*b* with the stubs 27*a,* 27*b,* such unnecessary corners can be eliminated, and the transmission lines connecting the antenna elements to the first stage hybrid circuits, and those connecting the second stage hybrid circuits to the first stage hybrid circuits can be made all straight. Accordingly, the circuit layout is simplified and the size of the feeder circuit 2 is made smaller.

Figure 10:
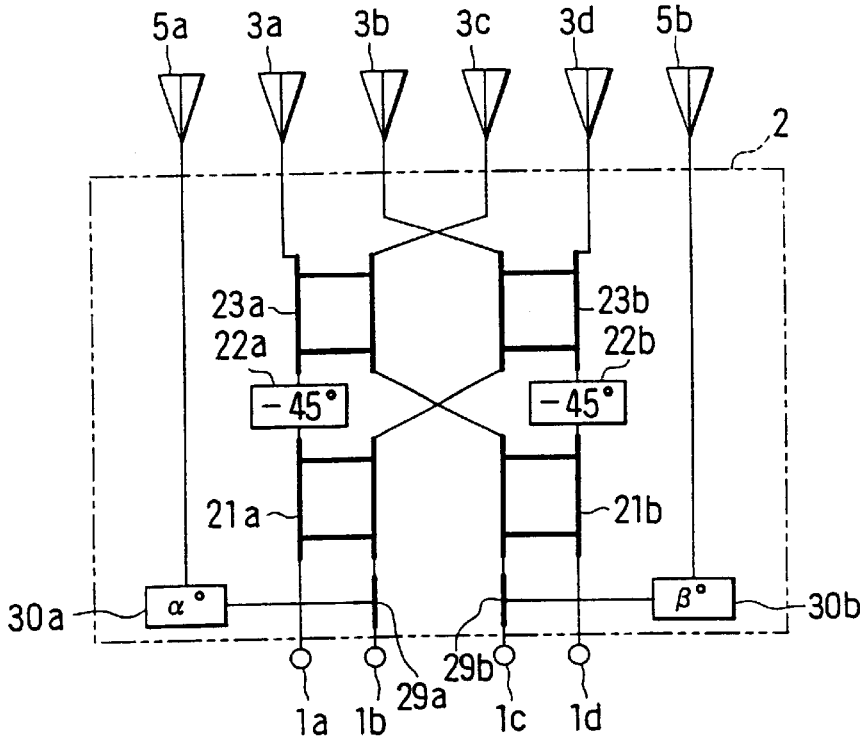
FIG. 10 is a drawing showing a multibeam antenna as a second embodiment of the present invention.

A second embodiment of the present invention will be described in reference to FIGS. 10, 11 and 12. When the phase difference between antenna elements becomes large, the antenna gain decreases. To cope with this problem, power is fed to the auxiliary antenna elements 5*a,* 5*b* from the input port side of the feeder circuit 2 as shown in FIG. 10. Power dividers 29*a* and 29*b* are disposed at the input ports 1*b* and 1*c,* respectively, and the power, the phase of which is adjusted by constant-phase shifters 30*a,* 30*b,* is distributed to the auxiliary antenna elements 5*a,* 5*b.* When the power is input from the input ports 1*b* or 1*c* and the phase difference becomes large, an antenna array is constituted by five antenna elements. When power is input from the input ports 1*a* or 1*d,* an antenna array is constituted by four antenna elements. Thus, the antenna gain deviation according to the input ports from which the power is input is suppressed. The phase differences $\alpha°$ and $\beta°$ of the power distributed to the auxiliary antenna elements 5*a,* 5*b* are selected, so that the phase differences among all the antenna elements including auxiliary antenna elements become equal.

Figure 11:
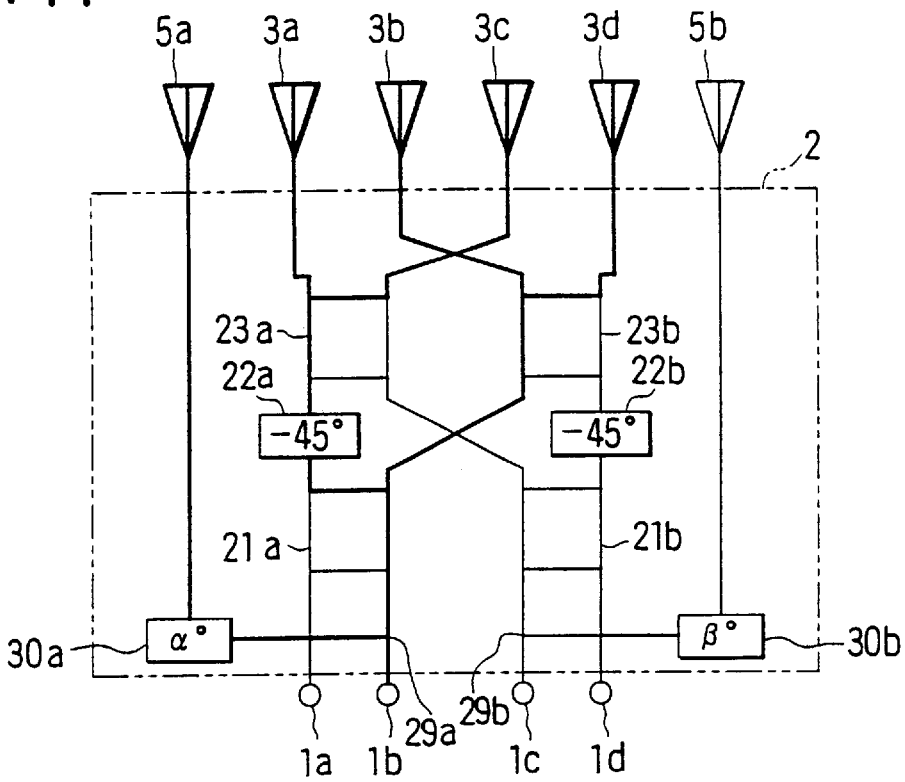
FIG. 11 is a drawing showing a flow of power in the second embodiment when the power is fed thereto from an input port 1*b;*
Figure 12:
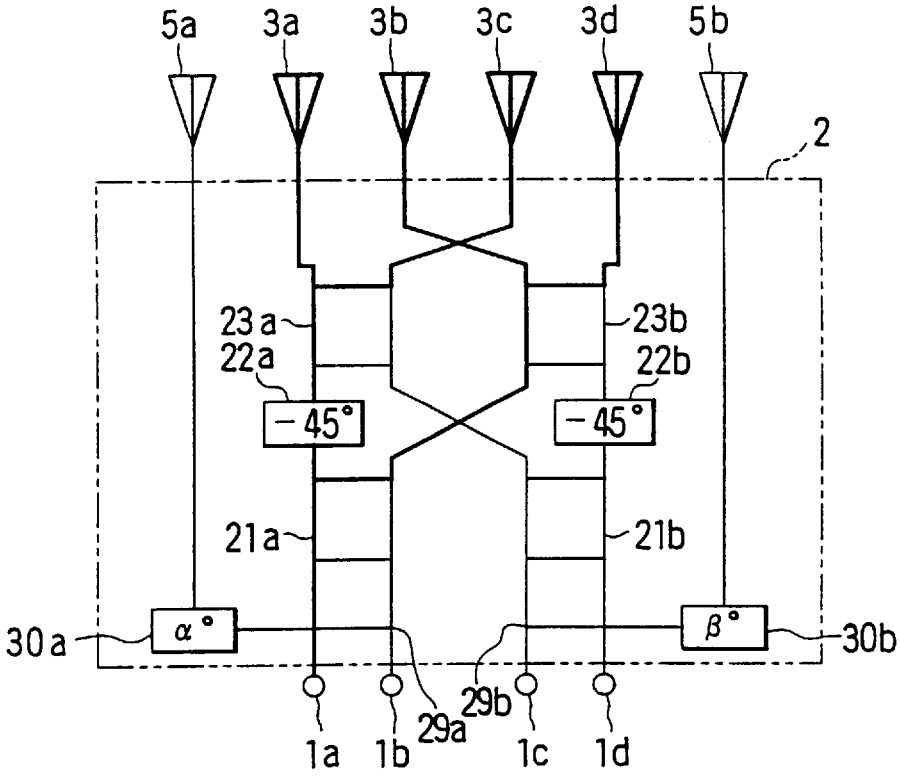
FIG. 12 is a drawing showing a flow of power in the second embodiment when the power is fed thereto from an input port 1*a;*

In FIG. 11, a power flow when the power is input from the input port 1*b* is shown. In this case, the antenna array is constituted by five antenna elements 3*a*–3*d* and 5*a*. In FIG. 12, a power flow when the power is input from the input port 1*a* is shown. In this case, the antenna array is constituted by four antenna elements 3*a*–3*d*.

Figure 13:
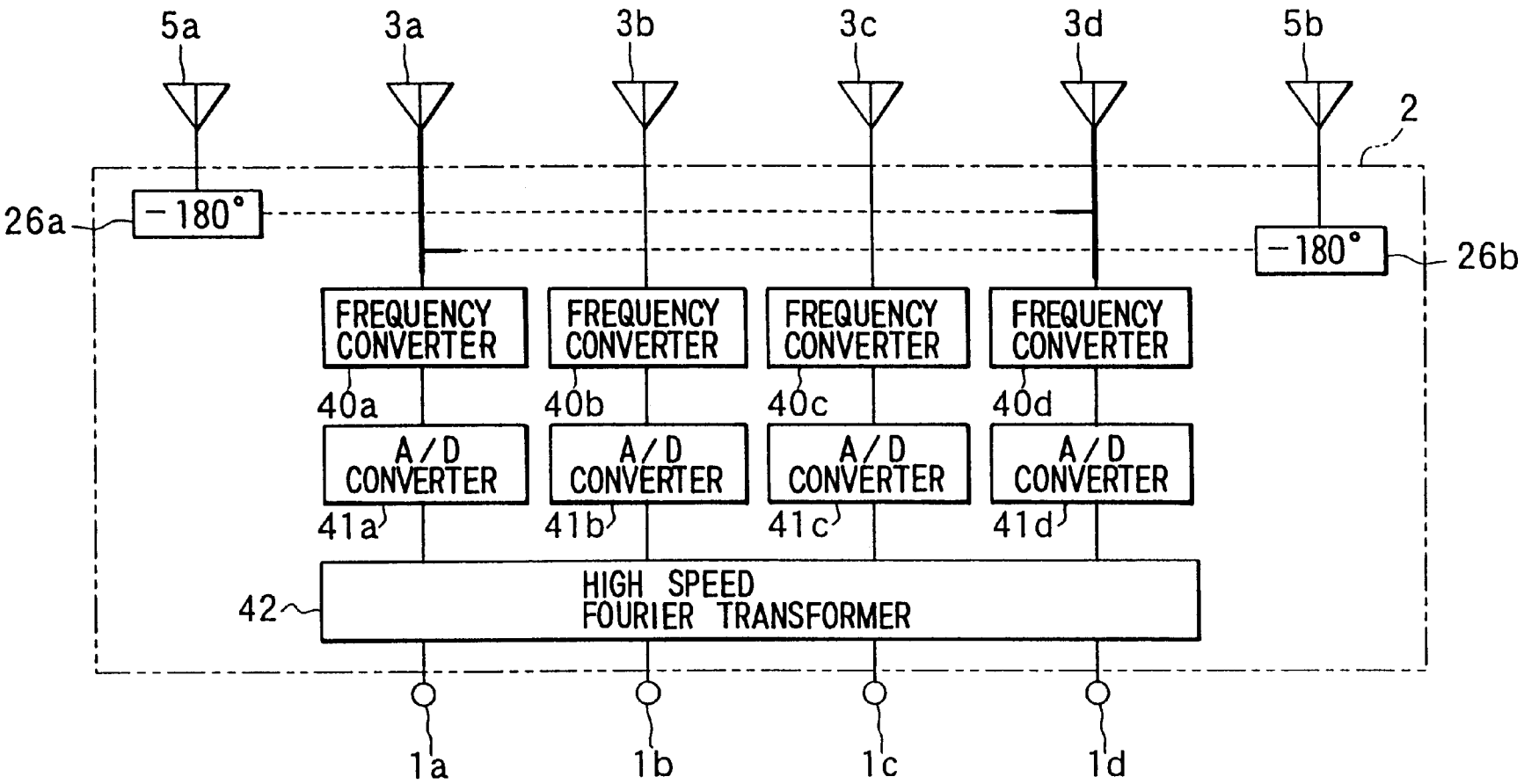
FIG. 13 is a drawing showing a multibeam antenna as a third embodiment of the present invention.

A third embodiment of the present invention will be described in reference to FIG. 13. Since the Butler-matrix feeder circuit is structured based on the fast Fourier transform (FFT) theory in digital signal processing, similar beams as in the Butler-matrix antenna can be formed by performing Fourier transform under the digital beam forming (DBF). The third embodiment shown in FIG. 13 is structured based on this concept. Frequency converters 40*a*–40*d* are connected to the output port side of the feeder circuit 2, and the outputs from the frequency converters 40*a*–40*d* are converted into digital signals by A/D converters 41*a*–41*d* connected to the frequency converters. Then, Fourier transform is performed on the digital signals by a fast Fourier transformer 42. In this manner, the same multiple beams as those in the first embodiment can be formed.

Figure 14:
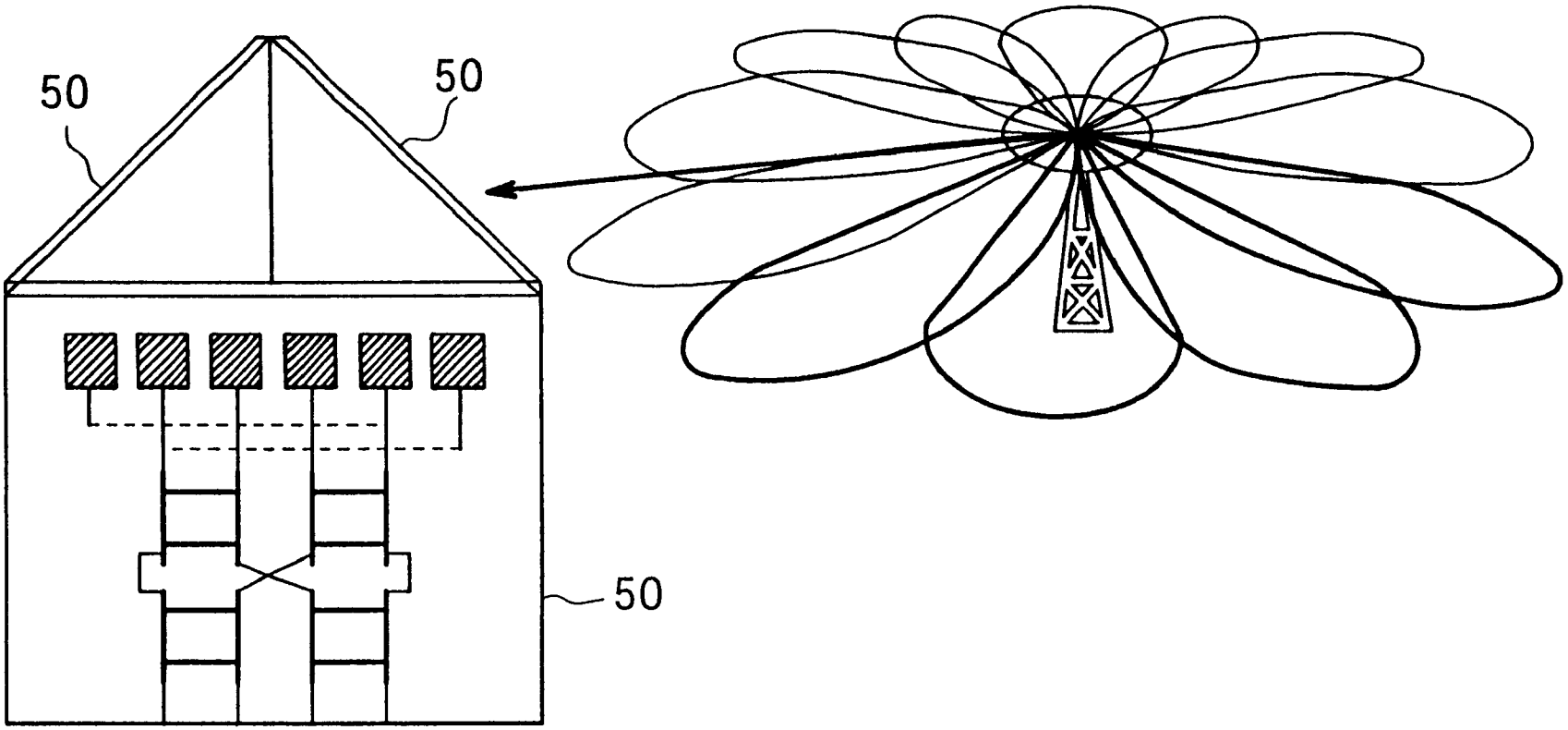
FIG. 14 is a schematic chart showing an antenna system as a fourth embodiment of the present invention.

An antenna system as a fourth embodiment of the present invention is shown in FIG. 14. Three Butler-matrix antennas 50, each of which is the same as that of the first embodiment, are arranged in a triangle-pillar-shape. In this manner, 12 beams covering all the directions are formed, and communication covering 360° can be performed by this antenna system. Three Butler-matrix antennas may be disposed around a cylindrical pillar by bending those antennas. The antenna elements may be separated from the feeder circuit, and only the antenna elements can be arranged in a triangular or a cylindrical shape.

Figure 15:
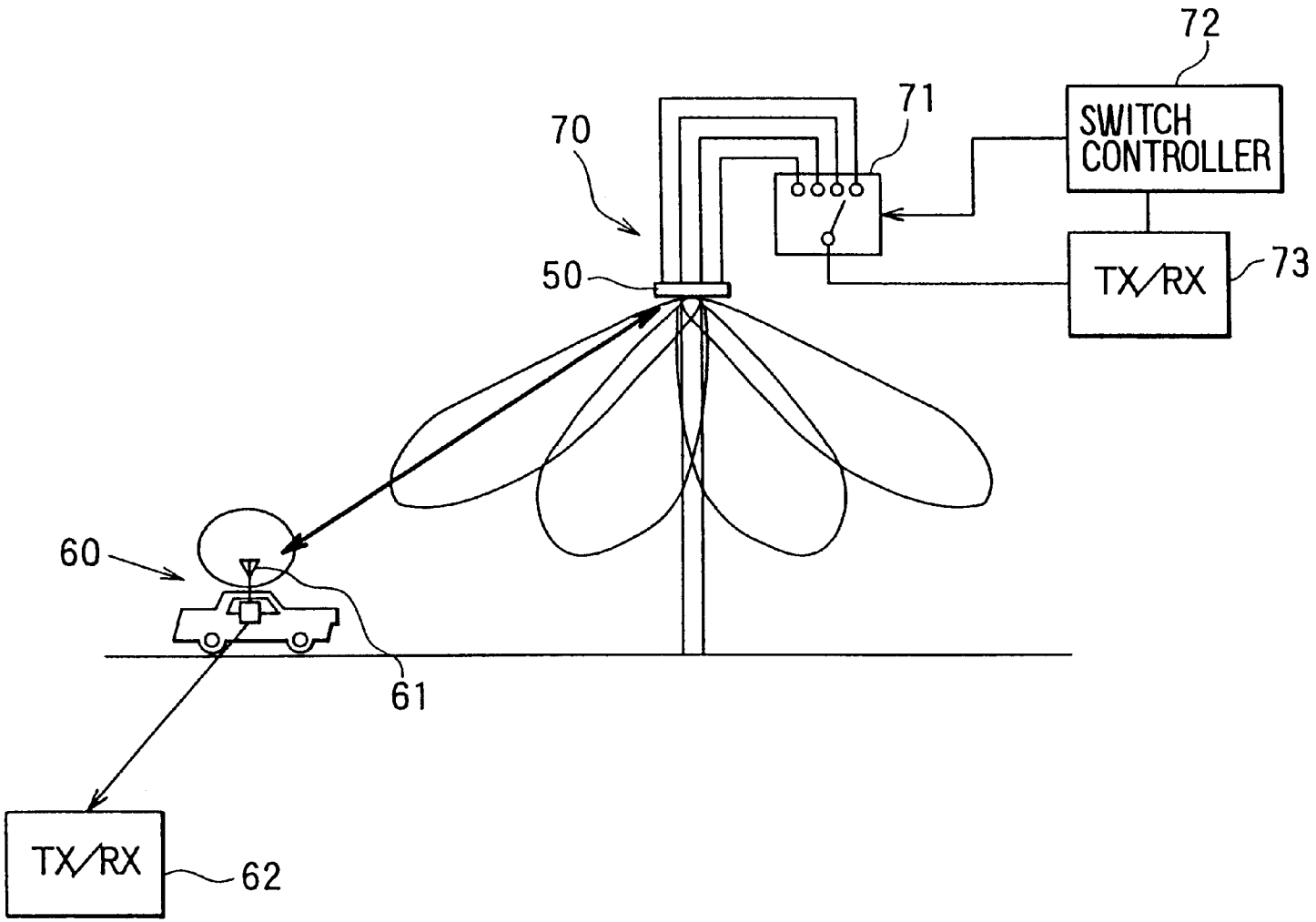
FIG. 15 is a schematic chart showing an antenna system as a fifth embodiment of the present invention, the system being for use as a terminal antenna system in mobile communication.

FIG. 15 shows an antenna system as a fifth embodiment of the present invention. A multibeam antenna 50 which is the same one described as the first embodiment is located over a road and used as an antenna of a communication terminal 70. An antenna 61 for communicating with the base terminal 70 is mounted on an automotive vehicle 60. The antenna 61 may be a low gain antenna. The automobile 60 carries an on-board transmitter-receiver (TX/RX) 62 connected to the antenna 61. The communication terminal 70 includes a switching circuit 71 for changing the radiation pattern of the multibeam antenna 50, a switch controller 72 and a transmitter-receiver 73.

The multibeam antenna 50 forms four beams directed downward as shown in FIG. 15, and the radiation pattern of the multibeam antenna is switched by the switching circuit 71. In this manner, communication between the automobile 60 and the communication terminal 70 is effectively performed. This antenna system is especially advantageous when the automobile carries a low gain antenna.

Figure 16:
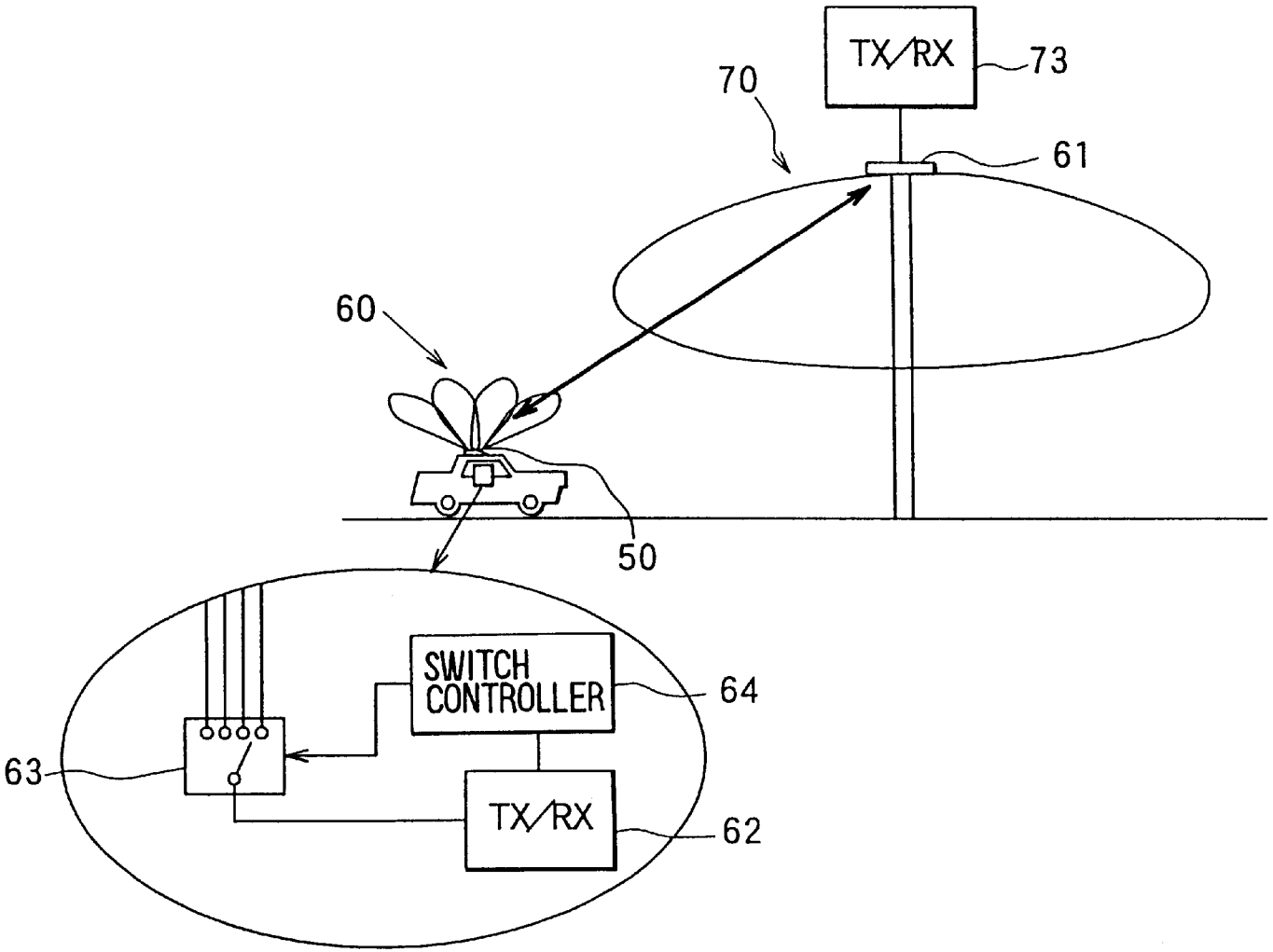
FIG. 16 is a schematic chart showing an antenna system as a sixth embodiment of the present invention, the system being for use as an on-board antenna system in mobile communication.

FIG. 16 shows another antenna system as a sixth embodiment of the present invention. In this system, the multibeam antenna 50 which is the same one described as the first embodiment is used as an antenna of an automobile 60. The automobile 60 carries an on-board transmitter-receiver 62, a switching circuit 63 for switching the beam directivity of the multibeam antenna 50 and a switch controller 64. The communication terminal 70 includes a transmitter-receiver 73 and a low gain antenna 61 which forms a downward beam as shown in FIG. 16.

Since the beam directions of the on-board multibeam antenna 50 are changeable, quality communication between the automobile 60 and the communication terminal 70 can be effectively performed.

Figure 17:
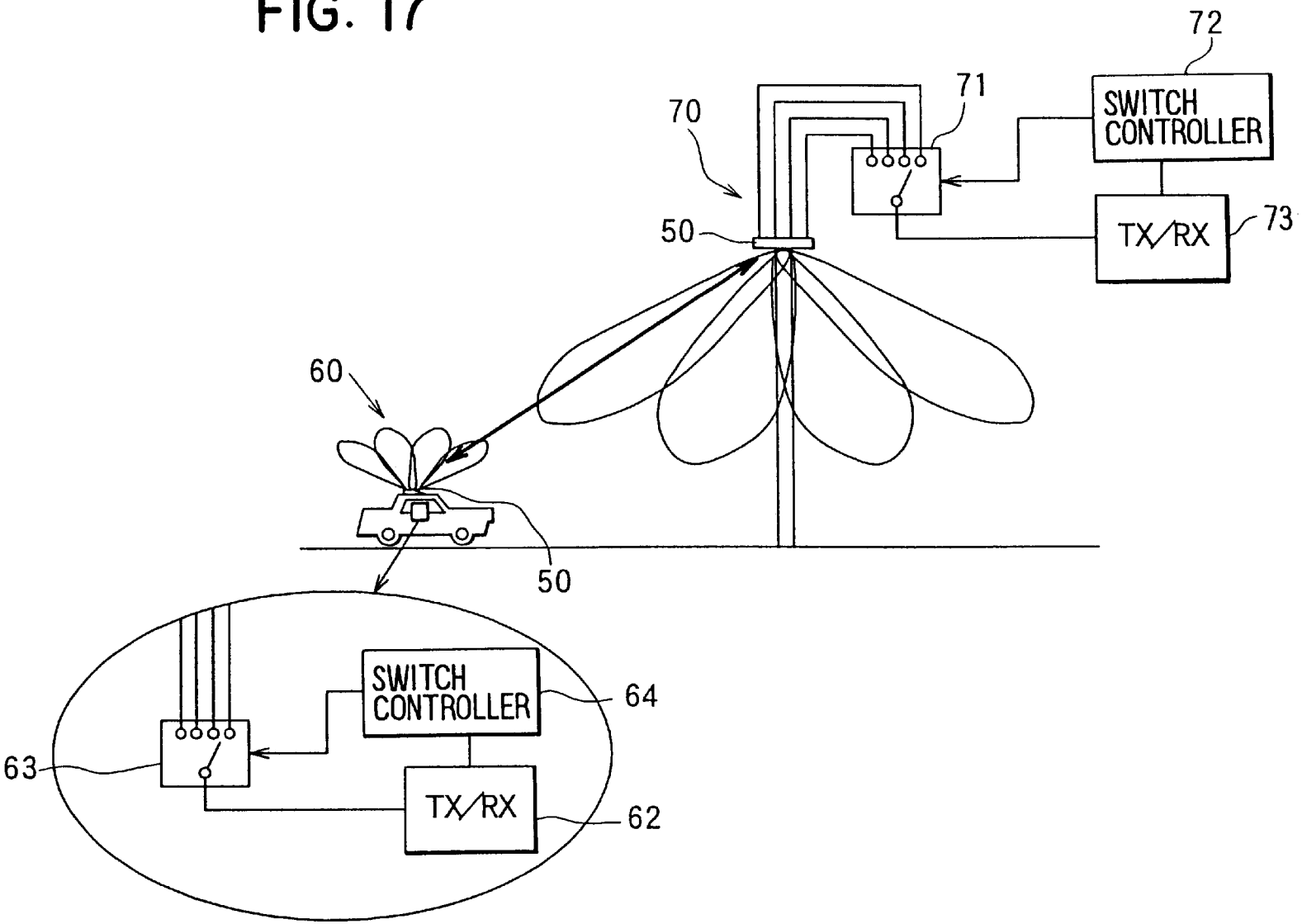
FIG. 17 is a schematic chart showing an antenna system as a seventh embodiment of the present invention, the system being for use in mobile communication.

Another antenna system as a seventh embodiment of the present invention is shown in FIG. 17. In this system, the multibeam antenna 50 which is the same one described as the first embodiment is used both in the communication terminal 70 and on the automobile 60. The automobile 60 carries a transmitter-receiver 62, a switching circuit 63 and a switch controller 64. The communication terminal 70 includes a transmitter-receiver 73, a switching circuit 71 and a switch controller 72.

The multibeam antenna 50 of the communication terminal 70 forms beams directed downward, and the on-board mutibeam antenna 50 forms upward beams. Since the beam directions of both antennas are changeable, quality communication between the terminal 70 and the automobile 60 is realized.

Figure 18:
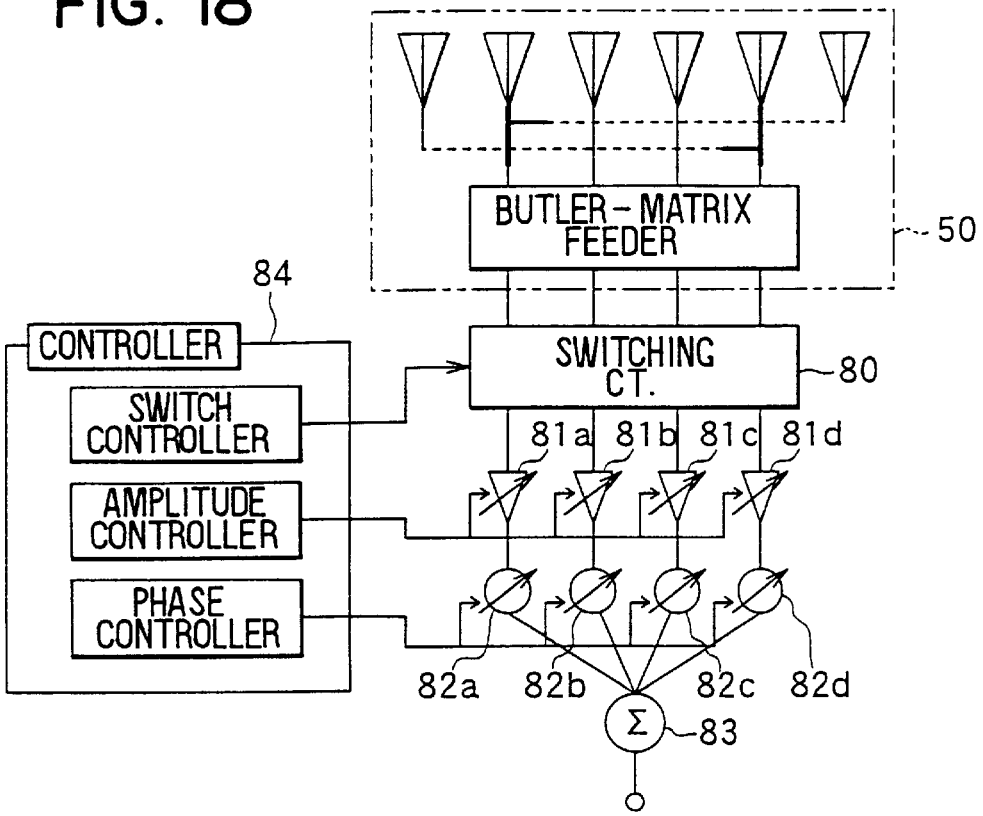
FIG. 18 is a drawing showing a multibeam antenna system as an eighth embodiment of the present invention.
Figure 19:
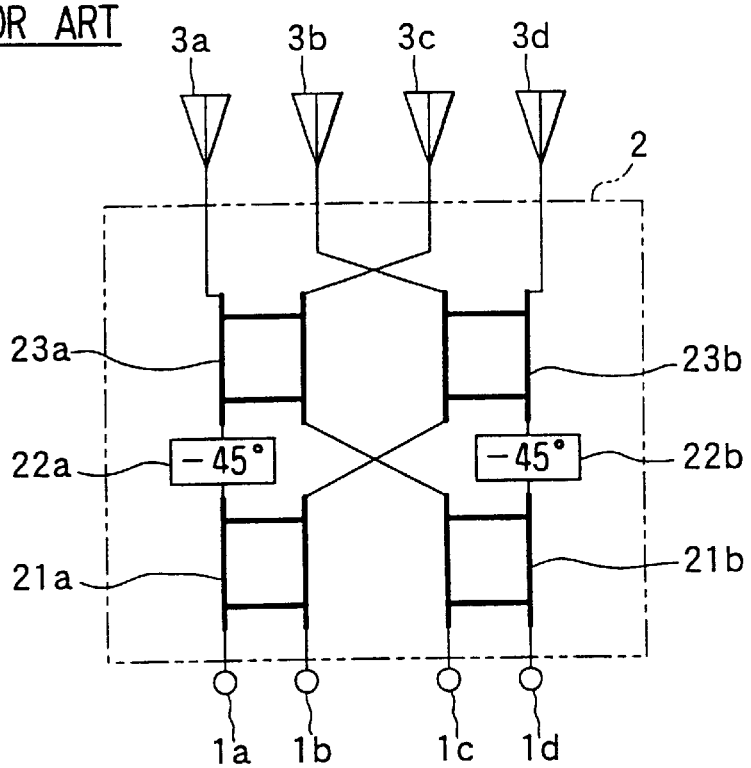
FIG. 19 PRIOR ART
FIG. 19 is a drawing showing a conventional Butler-matrix antenna.

FIG. 18 shows an antenna system in which the multibeam antenna 50 that is the same one described as the first embodiment of the present invention is used. A switching circuit 80, amplifiers 81*a*–81*d,* variable-phase shifters 82*a*–82*d,* a power combiner 83, and a controller 84 are connected to the multibeam antenna 50 as shown in FIG. 18. The controller 84 includes a switch controller for controlling the switching circuit 80, an amplitude controller for controlling the amplifiers 81*a*–81*d,* and a phase controller for controlling the variable-phase shifters 82*a*–82*d.*

The switching circuit 80 arbitrarily selects the number of antenna beams. The selected beams are amplified by the amplifiers 81*a*–81*d,* and then weighted by the variable-phase shifters 82*a*–82*d.* Outputs from the variable-phase shifters 82*a*–82*d* are combined into one output by the power combiner 83. The beam directions of the multibeam antenna 50 and its null-point direction are effectively controlled in this antenna system.

Though four main antenna elements, an auxiliary antenna element located at the left side of the main antenna elements and an auxiliary antenna element located at the right side are used in the various embodiments described above, the auxiliary antenna elements may be located only at one side of the main antenna elements. Further, the number of main antenna elements can be arbitrarily selected, as long as the number is $2^n$, and also the number of the auxiliary antenna elements can be arbitrarily selected, as long as that number is equal to the number of main antenna elements or less. The auxiliary antenna elements may be located either at both sides or only one side of the main antenna elements. Arrangement of the auxiliary antenna elements is not limited to one dimensional array, but may be two-dimensionally arranged.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A multibeam antenna comprising:

a Butler-matrix feeder circuit;

transmission lines built in the Butler-matrix feeder circuit;

$2^n$ main antenna elements to which power is supplied from the Butler-matrix feeder circuit through the transmission lines; and $2^n$ or less auxiliary antenna elements constituting an auxiliary antenna group, the auxiliary antenna group being located at either one or both sides of the main antenna elements, thereby forming an antenna element array together with the main antenna elements, the power being distributed from the Butler-matrix feeder circuit to the auxiliary antenna elements through the transmission lines.

2. The multibeam antenna as in claim 1, wherein:

a phase difference between two neighboring antenna elements is made equal throughout the antenna element array.

3. The multibeam antenna as in claim 2, wherein:

a second power, a phase of which is 180-degree-shifted from a phase of a first power supplied to one of the main antenna elements, is distributed to one of the auxiliary antenna elements which is located apart from the one of the main antenna elements by $2^n$ antenna elements in the antenna element array.

4. The multibeam antenna as in claim 2 or 3, wherein:

stubs for making the phase difference between two neighboring antenna elements equal are disposed in the transmission lines.

5. The multibeam antenna as in claim 1, 2 or 3, wherein:

all of the main and auxiliary antenna elements are located with equal intervals therebetween in the antenna element array.

6. The multibeam antenna as in claim 1, 2 or 3, wherein:

the power from the Butler-matrix feeder circuit is distributed to all of the main and auxiliary antenna elements, so that less power is supplied to the antenna elements remoter from a center of the antenna element array.

7. The multibeam antenna as in claim 1, 2 or 3, wherein:

all of the main and auxiliary antenna elements are circularly polarized antenna elements.

8. The multibeam antenna as in claim 1, 2 or 3, wherein:

the power to be fed to the auxiliary antenna elements is directly distributed from an input port of the Butler-matrix feeder circuit through power dividers.

9. A multibeam antenna comprising:

a Butler-matrix feeder circuit;

transmission lines built in the Butler-matrix feeder circuit;

four main antenna elements to which power is supplied from the Butler-matrix feeder circuit through the transmission lines; and an auxiliary antenna element located at one side of the main antenna elements, and another auxiliary antenna element located at the other side of the main antenna elements, thereby forming an antenna element array including the main and auxiliary antenna elements, so that all the antenna elements can be identified with sequential numbers from No. 1 to No. 6 ascending from one side of the array toward the other side of the array;

a power divider for distributing power supplied to No. 5 main antenna element to No. 1 auxiliary antenna element, a phase of the power distributed to No. 1 auxiliary antenna element being 180-degree shifted from a phase of the power supplied to No. 5 main antenna element; and another power divider for distributing power supplied to No. 2 main antenna element to No. 6 auxiliary antenna element, a phase of the power distributed to No. 6 auxiliary antenna element being 180-degree shifted from a phase of the power supplied to No. 2 main antenna, wherein:

a phase difference between two neighboring antenna elements is made equal throughout the antenna element array; and the transmission line connected to No. 2 main antenna element crosses the transmission line connected to No. 3 main antenna element, and the transmission lined connected to No. 5 main antenna element crosses the transmission line connected to No. 4 main antenna element.

10. A multibeam antenna comprising:

$2^n$ main antenna elements; and $2^n$ or less auxiliary antenna elements constituting an auxiliary antenna group, the auxiliary antenna group being located at either one or both sides of the main antenna elements, thereby forming an antenna element array together with the main antenna elements, wherein:

a second electric power, a phase of which is 180-degree shifted from a phase of a first electric power supplied to one of the main antenna elements, is distributed to one of the auxiliary antenna elements which is located apart from the one of the main antenna elements by $2^n$ antenna elements in the antenna element array;

a phase difference between two neighboring antenna elements is made equal throughout the antenna element array; and frequency conversion and analog-digital conversion are performed for the main antenna elements, and then fast Fourier transform is performed, so that multiple beams are formed by the antenna element array.

11. A multibeam antenna comprising:

a Butler-matrix feeder circuit;

transmission lines built in the Butler-matrix feeder circuit;

$2^n$ main antenna elements to which power is supplied from the Butler-matrix feeder circuit through the transmission lines; and $2^n$ or less auxiliary antenna elements constituting an auxiliary antenna group, the auxiliary antenna group being located at either one or both sides of the main antenna elements, thereby forming an antenna element array together with the main antenna elements, power being distributed from the Butler-matrix feeder circuit to the auxiliary antenna elements through the transmission lines, wherein:

a phase difference between two neighboring antenna elements is made equal throughout the antenna element array; and a second power, a phase of which is 180-degree-shifted from a phase of a first power supplied to one of the main antenna elements, is distributed to one of the auxiliary antenna elements which is located apart from the one of the main antenna elements by $2^n$ antenna elements in the antenna element array.

12. An antenna system comprising:

three multibeam antennas defined in claim 11; and a triangular or round pillar for mounting the three multibeam antennas thereon, wherein:

the three multibeam antennas are mounted on the pillar so that multiple beams formed by the antennas are uniformly directed to all directions to cover 360-degree communication around the antenna system.

13. An antenna system comprising:

the multibeam antenna defined in claim 11 located over a road so that multiple beams formed by the multibeam antenna are directed toward the road to perform wireless communication with vehicles driving on the road.

14. An antenna system comprising:

the multibeam antenna defined in claim 11 mounted on a vehicle driving on a road, so that multiple beams formed by the multibeam antenna are directed upward; and an antenna of a communication terminal located over the road to perform wireless communication between the communication terminal and the vehicle.

15. An antenna system comprising:

a multibeam antenna defined in claim 11 carried by a vehicle driving on a road, so that multiple beams formed by the multibeam antenna are directed upward; and another multibeam antenna defined in claim 11 located over the road to transmit multiple beams formed by the multibeam antenna toward the vehicle for performing wireless communication with the vehicle.

16. An antenna system comprising:

a multibeam antenna defined in claim 11;

a switching circuit for selecting one or more beams from multiple beams formed by the multibeam antenna;

an amplifier circuit for amplifying the selected beams;

a phase shifter for controlling phases of the amplified beams; and a power combiner for combining outputs from the phase shifter into one output.

* * * * *